US007100410B2

(12) United States Patent
Yamakawa et al.

(10) Patent No.: US 7,100,410 B2
(45) Date of Patent: Sep. 5, 2006

(54) METHOD OF MANUFACTURING SEAMLESS TUBE

(75) Inventors: Tomio Yamakawa, Amagasaki (JP); Kazuhiro Shimoda, Amagasaki (JP)

(73) Assignee: Sumitomo Metal Industries, Ltd., Osaka (JP)

( * ) Notice: Subject to any disclaimer, the term of this patent is extended or adjusted under 35 U.S.C. 154(b) by 0 days.

(21) Appl. No.: 11/281,485

(22) Filed: Nov. 18, 2005

(65) Prior Publication Data

US 2006/0065032 A1 Mar. 30, 2006

Related U.S. Application Data

(63) Continuation of application No. PCT/JP04/07216, filed on May 20, 2004.

(30) Foreign Application Priority Data

May 21, 2003 (JP) ..... 2003-142958

(51) Int. Cl.
*B21B 19/04* (2006.01)

(52) U.S. Cl. ..... 72/97

(58) Field of Classification Search ..... 72/96, 72/97, 99, 365.2, 366.2
See application file for complete search history.

(56) References Cited

U.S. PATENT DOCUMENTS

| | | | | |
|---|---|---|---|---|
| 4,827,750 | A * | 5/1989 | Hayashi | 72/97 |
| 5,636,542 | A * | 6/1997 | Yamakawa et al. | 72/97 |
| 5,713,234 | A * | 2/1998 | Yamakawa et al. | 72/97 |
| 6,089,066 | A * | 7/2000 | Cernuschi et al. | 72/97 |

FOREIGN PATENT DOCUMENTS

| | | | |
|---|---|---|---|
| CN | 9610024.5 | | 3/1996 |
| DE | 69620310 | | 11/2002 |
| EP | 0754503 | | 1/1997 |
| JP | 61-003605 | | 1/1986 |
| JP | 62-282713 | | 12/1987 |
| JP | 03-013222 | | 1/1991 |
| JP | 6-218406 | * | 8/1994 |
| JP | 06-218406 | | 8/1994 |
| JP | 2000-140911 | | 5/2000 |
| WO | WO96/21526 | | 7/1996 |

* cited by examiner

*Primary Examiner*—Ed Tolan
(74) *Attorney, Agent, or Firm*—Clark & Brody

(57) ABSTRACT

A method of manufacturing a seamless tube by the invention can duly control the rotary forging effect without miss-rolling such as defective onset engagement with rolls by satisfying either of (1)–(3) formulas below, dependent on a given range of roll diameter ratio Dg/D1, prevent the occurence of internal surface flaws at the top of the work material attributable to deteriorated hot workability, and further prevent the occurrence of said flaws over the remaining length without altering parameters for piercing-rolling process. Thus, the invention can be widely utilized as an excellent manufacturing method for said tube:

in case of Dg/D1<1.1, $$23 \leqq N/(Df/100) \leqq 40, \quad (1)$$

in case of 1.1≦Dg/D1<1.5, $$20 \leqq N/(Df/100) \leqq 44, \quad (2)$$

in case of 1.5≦Dg/D1≦1.8, $$20 \leqq N/(Df/100) \leqq 48. \quad (3)$$

1 Claim, 2 Drawing Sheets

METHOD OF MANUFACTURING SEAMLESS TUBE

CROSS-REFERENCE TO RELATED APPLICATIONS

This application is a continuation of International Patent Application No. PCT/JP2004/007216 filed May 20, 2004. This PCT application was not in English as published under PCT Article 21(2).

FIELD OF THE INVENTION

The present invention relates to a method of manufacturing either seamless tubes or pipes (hereinafter, a tube or pipe is referred to as a tube generically) by means of a piercer mill (piercing-rolling mill) to be used in a Mannesmann tube-making method that is a representative of a tube-making method of a seamless tube, and more specifically relates to a method of manufacturing a seamless tube which reduces miss-rolling such as defective onset engagement with rolls and/or prevents the occurrence of internal surface flaws over the entire length even in a tube-making process applied for a billet having 5% or more of chromium as well as a billet made of hard-working material, irrespective of non-ferrous material or steel, that is obtained by a continuous casting method.

BACKGROUND ART

In a Mannesmann tube-making method, which has been widely used in a representative tube-making method for a seamless tube, a solid round billet heated at a predetermined temperature is processed by a piercer mill into a hollow tube stock. Then, said method is outlined that the obtained hollow tube stock is elongated by a mandrel mill consisting of 5 to 8 stands, reheated and processed, or alternatively being processed without reheating, by either a stretch-reducer mill or a sizer mill to obtain a predetermined outside diameter, subsequently followed by a finishing process, thereby obtaining a final product.

In a piercing-rolling process by a piercer mill, a pair of barrel-type or cone-type rolls whose center lines are inclined with respect to the pass line are disposed as opposed to each other. Further, a plug for use in piercing-rolling process is held at the tip of the mandrel, that is provided along the pass line lying between a pair of inclined rolls.

Normally, the cone-type inclined rolls are adopted as a piercing roll for use in piercing-rolling process since the quality of the pierced goods is excellent and the efficiency of piercing operation is high.

FIG. 1 is a diagram explaining schematically a configuration of cone-type inclined rolls for use in a piercing-rolling process. FIG. 2 is a diagram, seen in the direction of an arrow A—A for the foregoing diagram, explaining a configuration of cone-type inclined rolls.

The inclined rolls 1 comprises a gorge 1*a* having a roll diameter Dg in its mid-span, an inlet face 1*b* which is a side face of a near truncated circular cone in such a manner that the diameter decreases from the gorge 1*a* toward the inlet endmost, and an outlet face 1*c* which is a side face of a near truncated circular cone in such a manner that the diameter increases toward the outlet endmost, thereby resulting in the cone-type form as a whole.

The inclined rolls 1 are disposed so that each centerline of the rolls crosses the pass line X—X at a cross angle $\gamma$ respectively. Further, as shown in FIG. 2, a first inclined roll

1 is disposed so that the center line of the roll crosses the pass line X—X at an inclination angle $\beta$. Meanwhile, another inclined roll 1 that is not shown in FIG. 2 is disposed as opposed to the first inclined roll so that the centerline of another roll crosses the pass line X—X at a reverse angle $\beta$ which is symmetric with respect to the pass line X—X.

The inclined rolls 1 intended for applying a rotational movement to the billet 3 are directly connected with each driving mechanism 4, thus enabling each roll to independently rotate around its centerline.

And a plug 2 is configured to be an artillery shell form as a whole, and the rear end thereof is held at the tip of the mandrel bar M. Further, the rear end of the mandrel bar M, not shown in the diagram, is connected with the thrust block mechanism which can provide forward or backward movement in the length-wise direction to sustain the thrust force in rolling direction which being exerted onto the plug 2, as well as to adjust the position of the plug.

In a piercing mill with the foregoing configuration, when the billet 3 that is mobilized along the pass line X—X in the direction shown by a hollow arrow travels along the pass line X-X while rotating at the in-between space of the inclined rolls, a borehole is made by the plug to the centerline of the billet and subsequently a wall thinning by means of the inclined rolls 1 coupled with the plug 2 takes place, thereby obtaining a hollow tube stock.

Meanwhile, in the foregoing piercing-rolling process, the billet is subjected to a piercing-rolling process by a pair of the inclined rolls while rotating and moving forward during the period from being fed into the inclined rolls to the travel down to the nose of the plug. In this regard, so called rotary forging effect (Mannesmann effect) works, resulting in rendering the centerline portion of the billet fragile, thus reaching a state that a piercing-rolling process can be readily executed. In case the rotary forging effect is excessive, the voids likely generate at the centerline portion, and in extreme case the centerline portion gets fractured, likely resulting in radial cracking.

In such a case, especially when a continuously cast material likely having a center segregation and/or a center porosity, a stainless steel with 5% or more Cr likely having $\delta$ ferrite, or a non-ferrous billet such as copper or copper alloy that a dendrite structure likely remains and impairs the workability is subjected to a piercing-rolling process by a piercer mill, cracks develop at the centerline portion of the billet due to the rotary forging effect during the period from being fed into the rolls to the travel down to the nose of the plug, thus being left behind as internal surface flaws of a hollow tube stock after rolling operation. In order to eliminate these internal surface flaws, various methods are proposed up to date.

In general, in a piercing-rolling process by a piercer mill, a plug position and an opening angle between the inclined rolls are adjusted to set a smaller draft rate of the billet at the position where the nose of the plug is located (a plug nose draft rate). For instance, in Japanese Patent Application Publication No. 03-13222, after the billet is engaged with the inclined rolls, it is disclosed that an opening angle of the inclined rolls and the plug lead are altered simultaneously so that a plug nose draft rate in the state of rolling at the mid-length of the billet becomes smaller than the plug nose draft rate in the state of rolling at the top or bottom of the billet.

According to the rolling method disclosed in foregoing Japanese Patent Application Publication No. 03-13222, a miss-rolling such as defective onset engagement with the rolls can be prevented and the occurrence of internal surface flaws attributable to the excessive rotary forging effect, excluding the top, and bottom portion of the hollow tube stock, can be avoided. However, since the onset engagement with the rolls at the top of the billet is mostly cared, it is suspected that the occurrence of internal surface flaws at the top of the hollow tube stock cannot be completely prevented. Also, a development of a new equipment which can alter the setting of the inclined rolls during a piercing-rolling process will be required.

Next, in Japanese Patent Application Publication No. 61-3605, there is disclosed a piercing method, wherein, based on the billet weight and the target dimension of the hollow tube stock, an opening angle of the inclined rolls and a plug lead setting are controlled so as to get a targeted value of the plug nose draft rate, thus preventing the occurrence of internal surface flaws. According to the proposed controlling method, it is suspected that even if the opening angle of the inclined rolls and the plug lead are set to the targeted values in accordance with the variation of a steel grade of the work material, the shape of the inclined rolls, a condition for piercing-rolling process and the like, the occurrence of miss-rolling such as defective onset engagement with rolls can not be completely prevented, although the occurrence of the internal surface flaws of the hollow tube stock may be prevented.

Further, in Japanese Patent Application Publication No. 2000-140911, there is disclosed a method of a piercing-rolling process, wherein the inclination angle of the inclined rolls is specified to be 12°–14° and, at the same time, the piercer mill is operated so that the ratio of the distance—from the position where the billet initially get engaged with the rolls to the nose of the plug—to the billet diameter becomes a specific condition, thereby enabling to prevent the occurrence of the internal surface flaws.

In the method of a piercing-rolling process disclosed in foregoing Japanese Patent Application Publication No. 2000-140911, it is suspected that the internal surface flaws especially at the top of the hollow tube stock cannot be completely prevented, although the miss-rolling and the internal surface flaws may be marginally prevented by said invention, similarly to the piercing-rolling process disclosed in foregoing Japanese Patent Application Publication No. 03-13222.

Thus, in case of a piercing-rolling operation for aforementioned hard-working material such as a continuously cast material and a stainless steel with 5% or more Cr that likely generates δ ferrite, there is a risk that internal surface flaws numerously generate at the top of the hollow tube stock. Further, a development of a new equipment that enables altering the roll setting during a piercing-rolling operation is required.

SUMMARY OF THE INVENTION

In the piercing-rolling process at the top of the billet by the piercer mill, not only miss-rolling such as defective onset engagement with rolls but also internal surface flaws attributable to the excessive rotary forging effect are mostly concerned. In this regard, the prior art cannot fully address these concerns.

Namely, in the controlling method disclosed by the foregoing Japanese Patent Application Publication No. 61-3605, it is considered that internal surface flaws can be prevented, but the defective onset engagement with rolls cannot be avoided. Meanwhile, in each piercing-rolling method disclosed by foregoing Japanese Patent Application Publication Nos. 03-13222 and 2000-140911, it is considered that, although the defective onset engagement with rolls can be avoided, the occurrence of internal surface flaws at the top of the hollow tube stock cannot be prevented.

The present invention is carried out to address these problems in the prior art and its object is to provide a method of manufacturing a seamless tube, wherein not only the occurrence of the miss-rolling such as defective onset engagement with rolls can be prevented, but also, by controlling the rotary forging effect properly, the internal surface flaws to be incurred by the rotary forging effect in association with the deterioration of hot workability due to the temperature drop especially at the top portion of the work material can be prevented, and wherein remaining portion next to the top portion can be processed so as to be free from the occurrence of the internal surface flaws without altering the setting parameters in piercing-rolling process, and, in other word, is to provide a method of manufacturing a seamless tube wherein neither miss-rolling nor the occurrence of the internal surface flaws over the entire length can take place.

The present inventors made several investigations on the piercing-rolling process by the piercer mill in order to solve foregoing problems. Consequently, it was found that the ratio of the inlet roll diameter at the position of the inclined roll, where the billet should start to contact, to the roll diameter at the gorge portion of the inclined roll and the ratio of the billet revolution to the diameter reduction rate of the billet at the onset engagement with rolls should greatly weigh with the occurrence of miss-rolling and the occurrence of the internal surface flaws, attributable to an excessive rotary forging effect, over the entire length including the top portion.

Herein, the billet revolution at the onset engagement with rolls is defined as the number of revolution where the top portion of the billet is subjected to reduction rolling by the inclined rolls during the period from its onset engagement with rolls to the travel down to the plug nose.

FIG. 3 is a diagram explaining schematically the piercing-rolling process for the billet wherein a plug is put in place between a pair of inclined rolls that are disposed as opposed to each other with respect to the pass line. In this diagram, the inclination angle β of the inclined roll 1 is set as zero. The gorge portion 1*a* of the cone-type inclined roll 1 is defined as the position where the inlet face 1*b* of the inclined roll 1 intersect with the outlet face 1*c* and the opening clearance between a pair of inclined rolls 1 comes to be minimal.

The roll diameter Dg (mm) is for the roll gorge 1*a*. The configuration of the inlet face 1*b* of the inclined rolls 1 can be either a cross-sectional shape having two or more stages of slopes, or having a curved contour.

Further, in geometrically two dimensional plane where the inclination angle β is zero as shown in FIG. 3, the roll diameter at the position A where the billet 3 first comes to contact with the inlet face 1*b* of the inclined rolls is designated by an inlet roll diameter D1 (mm). Besides, the lead distance (pass line lead) from the position A to the nose of the plug 2, in parallel with the pass line X—X, is designated by Ld (mm). The opening clearance of the inclined rolls at the nose position of the plug is designated by Rpg (mm), and the angle which the contour of inlet face 1*b* of the inclined roll creates with respect to the pass line X—X is designated by θ1 (hereinafter referred to as an inlet face angle).

Next, where the diameter of the billet 3 as the work material is designated by the diameter Bd (mm) and the inclination angle of the inclined rolls is designated by angle β (°), the billet revolution N and the billet diameter reduction rate Df at the onset engagement with rolls can be expressed by following formulas.

$$N=Ld/(2\pi\cdot Bd\cdot\tan\beta)$$

$$Df=\{(Bd-Rpg)/Bd\}\times 100$$

Then, the present inventors investigated the occurrence of the miss-rolling such as the defective onset engagement with rolls and the occurrence of internal surface flaws by applying the piercing-rolling process with the parameters shown in Table 1 to the billets with either 70 mm and 60 mm diameter that are machined from the centerline portion of the continuously cast slab of 190 mm in diameter, being made of 0.2% C steel.

Further, the experimentation of the piercing-rolling operation is conducted for the variance of the billet diameter reduction rate Df and the billet revolution N, which can be obtained by the foregoing formulas, as well as for the variance of the roll configuration. The relationship of the roll diameter ratio Dg/D1 thus obtained with N/Df or the ratio the billet revolution N to the billet diameter reduction rate Df is shown in Table 2.

TABLE 1

| | |
|---|---|
| Billet Diameter Bd | 70 mm, 60 mm |
| Roll Gorge Diameter Dg | 280 mm–410 mm |
| Inclination Angle β | 6°–16° |
| Cross Angle γ | 5°–30° |
| Inlet Face Angle θ1 | 2.5°–3.6° |
| Dg/D1 | 1.05–1.9 |
| N/Df/100 | 15–50 |
| D1/Bd | 1.9–5.1 |
| Hollow Tube Stock: Diameter | 72 mm, 62 mm |
| Hollow Tube Stock: Thickness | 8 mm–10 mm |

TABLE 2

| Dg/D1 | | 1.05 | 1.1 | 1.3 | 1.5 | 1.8 | 1.9 |
|---|---|---|---|---|---|---|---|
| N/DF/100 | 15 | Δ | Δ | ▲ | ▲ | ▲ | X |
| | 18 | ● | ● | Δ | Δ | Δ | ▲ |
| | 20 | ● | ○ | ○ | ○ | ○ | ○ |
| | 23 | ○ | ○ | ○ | ○ | ○ | ○ |
| | 30 | ○ | ○ | ○ | ○ | ○ | ○ |
| | 35 | ○ | ○ | ○ | ○ | ○ | ○ |
| | 40 | ○ | ○ | ○ | ○ | ○ | ○ |
| | 44 | ● | ○ | ○ | ○ | ○ | ○ |
| | 48 | ● | ● | ● | ○ | ○ | ○ |
| | 50 | ● | ● | ● | ● | ● | ○ |

The valuation shown in Table 2 is based on the visual inspection after acid pickling. In this valuation, the symbol ○ indicates that no internal surface flaw over the entire length of the hollow tube stock is generated and the piercing-rolling operation is carried out in success without any miss-rolling. On the other hand, the symbol ● indicates that the internal surface flaws are generated to the hollow tube stock.

Next, with regard to the miss-rolling, the symbol × denotes the case that the frequency of miss-rolling exceeds three in 20 piercing-rolling attempts while the symbol ▲ denotes the case that the frequency of miss-rolling remains to be two to three in 20 piercing-rolling attempts and the symbol Δ denotes the case that the frequency of miss-rolling is one in 20 piercing-rolling attempts.

From the result shown in foregoing Table 2, it is recognized that, in the domain where the roll diameter ratio Dg/D1 is small, the internal surface flaws likely generates whether N/Df or the ratio of the billet revolution N to the billet diameter reduction rate Df is either small or large. And in the domain where the roll diameter ratio Dg/D1 is large, although the occurrence of the internal surface flaws can be generally suppressed, the frequency rate of miss-rolling increases when N/Df or the ratio of the billet revolution N to the billet diameter reduction rate Df is small.

Further, not shown in Table 2, it turned out that, in the domain where D1/Bd or the ratio of the inlet roll diameter at the first contact position to the billet diameter Bd is small, for instance below 2.5, the onset engagement with rolls for the billet likely comes to unstable, thus likely resulting in frequent occurrence of miss-rolling.

The present invention is consummated based on the foregoing findings and the gist pertains to a following method of manufacturing a seamless tube. Namely, the invention provides a method of manufacturing a seamless tube in which a plug is provided along the pass line lying between a pair of cone-type inclined rolls that are put in place as opposed to each other with respect to the pass line, and a seamless tube is made by applying a piercing-rolling process while the billet as the work material is subjected to rotating and traveling, said method comprising of the step that said piercing-rolling process is applied so that Dg/D1 or the ratio of the roll diameter Dg (mm) at the gorge portion of the inclined roll to the inlet roll diameter D1 (mm), and N/Df or the ratio of the billet revolution N, which is given during the period from the onset engagement of said billet with rolls to the travel down to the plug nose, to the billet diameter reduction rate Df (%) satisfy either of following (1)–(3) formulas:

in case of Dg/D1<1.1, $$23\leqq N/(Df/100)\leqq 40, \quad (1)$$

in case of 1.1≦Dg/D1<1.5, $$20\leqq N/(Df/100)\leqq 44, \quad (2)$$

in case of 1.5≦Dg/D1≦1.8, $$20\leqq N/(Df/100)\leqq 48, \quad (3)$$

provided that following relationships are compatible, given by Ld: pass line lead (mm) from the position where the billet first engages with rolls to the plug nose, β: inclination angle (°) of the inclined rolls, and Rpg: opening clearance (mm) of the inclined rolls at the plug nose position, $$N=Ld/(2\pi\cdot Bd\cdot\tan\beta), \text{ and}$$

$$Df=\{(Bd-Rpg)/Bd\}\times 100.$$

BEST MODE FOR CARRYING OUT THE INVENTION

Figure 1:
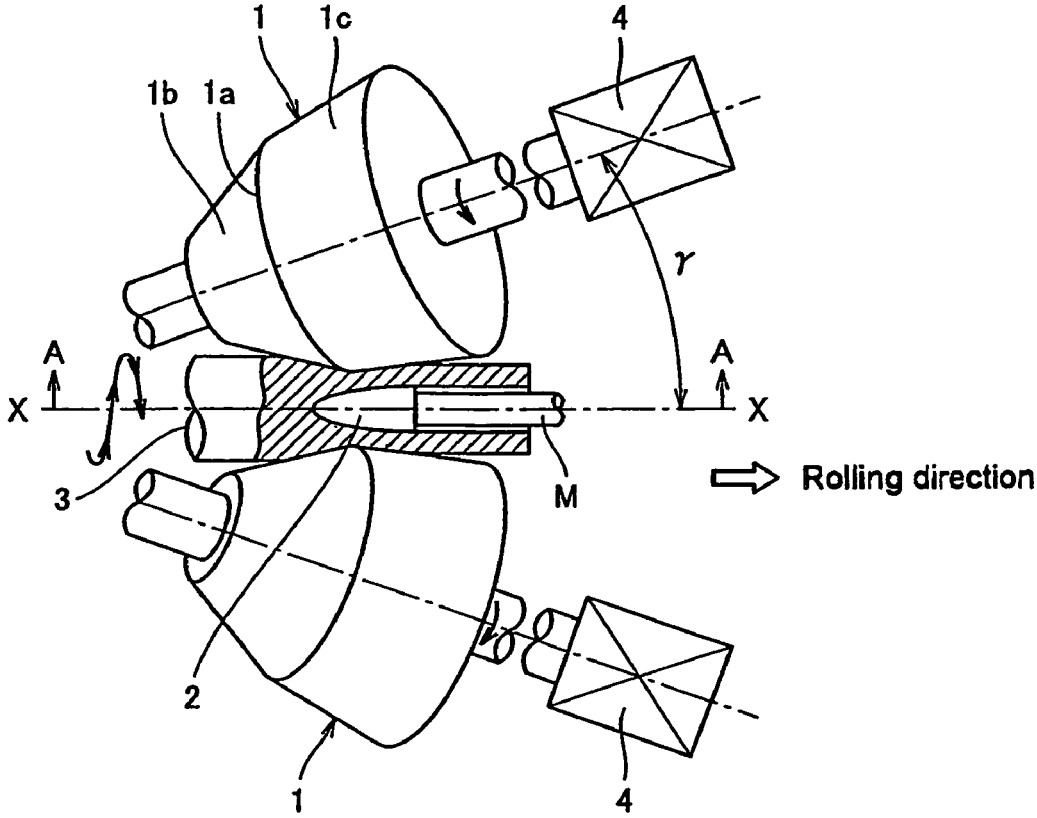
FIG. 1 is a diagram explaining schematically a configuration of cone-type inclined rolls for use in a piercing-rolling process.

A manufacturing method according to the present invention is featured such that, in order to prevent the occurrence of internal surface flaws over the entire length including the top portion of the hollow tube stock that are rolled, either of following (1)–(3) formulas is satisfied. Generally, as the roll diameter ratio Dg/D1 increases, it becomes effective in terms of preventing the occurrence of internal surface flaws, while there is an upper limit due to the equipment restraint.

For example, as the roll diameter Dg (mm) at the roll gorge portion gets large, the equipment scale gets large, thus resulting in an increase of the equipment cost. Meanwhile, as the inlet roll diameter D1 (mm) of the inclined rolls gets small, the problems relating to the equipment such as the decrease of the strength in bearing parts arise, and simultaneously, as the roll diameter ratio Dg/D1 gets larger, D1/Bd or the ratio of the inlet roll diameter D1 to the billet diameter Bd gets smaller, thereby likely causing frequent miss-rolling, which amounts to provide the upper limit for roll diameter ratio Dg/D1, the upper limit thereof being consequently set to be 1.8.

In case of Dg/D1<1.1, $$23 \leqq N/(Df/100) \leqq 40, \quad (1)$$

in case of 1.1≦Dg/D1<1.5, $$20 \leqq N/(Df/100) \leqq 44, \quad (2)$$

in case of 1.5≦Dg/D1≦1.8, $$20 \leqq N/(Df/100) \leqq 48. \quad (3)$$

The piercing-rolling process using a commercial mill is carried out in such a manner that the billet diameter reduction rate Df is set to be 4% to 8% as a norm. Therefore, when N/Df or the ratio of the billet revolution N to the billet diameter reduction rate Df at the onset engagement with rolls is set to satisfy either of (1) to (3) formulas, it is preferable that the condition of 4% to 8% in billet diameter reduction rate is also met in addition.

Further, in the manufacturing method according to the present invention, in order to prevent the occurrence of miss-rolling such as defective onset engagement with rolls, D1/Bd or the ratio of the inlet roll diameter D1 to the billet diameter Bd is preferably controlled to be greater than or equal to 2.5. Besides, the upper limit of D1/Bd is preferably set to be less than or equal to 6.5 as being restricted by equipment aspect.

In the piercing-rolling process using a commercial mill, whether the inlet face angle θ1 is either excessively large or excessively small, the reliability of the onset engagement of the billet with rolls gets reduced, and the in-processing work material comes to badly swing and swirl, which leads to unstable piercing, thereby the undesirable issue such as the wall thickness eccentricity arises.

Thus, it is preferable that the inlet face angle θ1 is set to be 2.5°–3.6°.

The manufacturing method according to the present invention, as aforementioned, ensures not only high quality of the tube stock thus made but also high piercing-rolling efficiency, whereby the cone-type inclined rolls are to be employed. The reasons why the barrel-type inclined rolls are not employed are such that it causes an inferior quality as well as poor efficiency and further it restricts the roll diameter ratio Dg/D1 to be less than or equal to 1.03, thereby it becomes technically difficult for the barrel-type inclined rolls to be employed in the manufacturing method by the present invention.

The manufacturing method by the present invention can exert remarkable effect in applying a piercing-rolling process by use of inclined piercing-rolling mill especially to a continuously cast material likely having a center segregation and/or a center porosity, a stainless steel containing Cr of 5% or more which likely having δ ferrite, or a non-ferrous billet such as copper or copper alloy likely having a dendrite structure remained, which affects the workability adversely.

In order to demonstrate the effect of the present invention, a piercing-rolling process using the method by the present invention with parameters shown in Examples 1 and 2 was applied to obtain the hollow tube stock, of which the result being recited in the followings.

EXAMPLE 1

Figure 2:
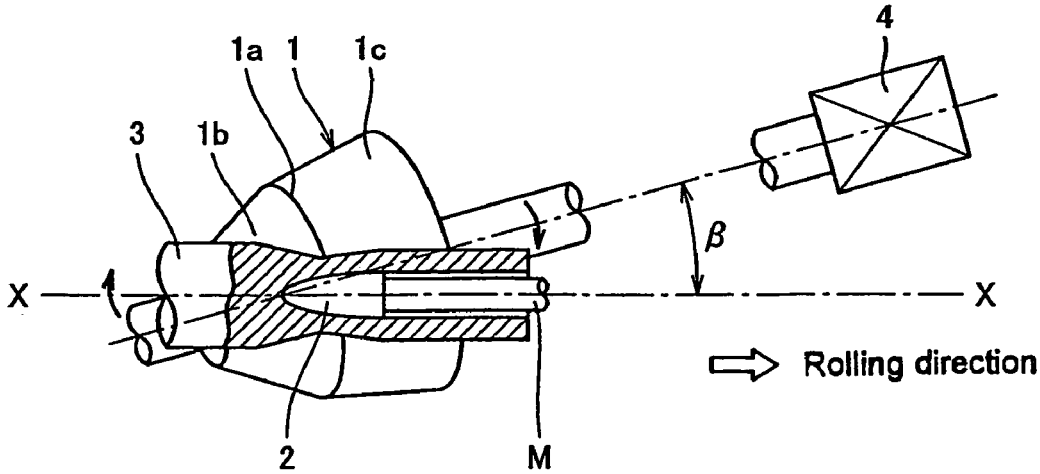
FIG. 2 is a diagram, seen in the direction of an arrow A—A for the foregoing diagram, explaining a configuration of cone-type inclined rolls.
Figure 3:
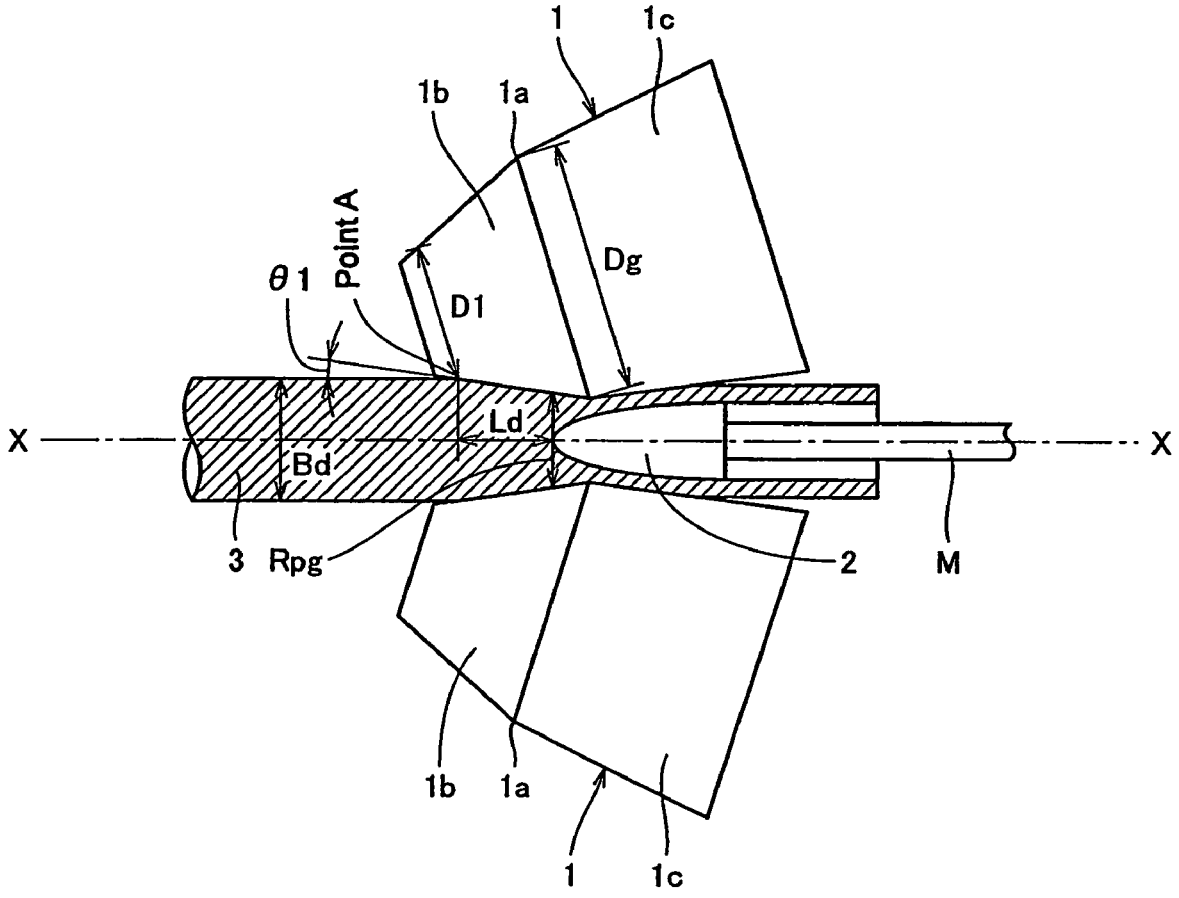
FIG. 3 is a diagram explaining schematically the piercing-rolling process for the billet wherein a plug is provided between a pair of inclined rolls that are disposed as opposed to each other with respect to the pass line.

A piercer mill with a configuration shown in the foregoing FIGS. 1 and 2 was used to apply a piercing-rolling process with parameters shown in Table 3 to a billet of 70 mm–100 mm in diameter, which is made of a martensitic stainless steel containing 13% Cr.

TABLE 3

| | |
|---|---|
| Billet Diameter Bd | 70 mm, 85 mm, 100 mm |
| Roll Gorge Diameter Dg | 350 mm–410 mm |
| Inclination Angle β | 8°–16° |
| Tube Stock Diameter | 72 mm–100 mm |
| Piercing Ratio | 2–3 |

The result that the tube stock was made through the piercing-rolling process is shown in Table 4 below. The symbol ○ in the column of occurrence of internal surface flaws in Table 4 indicates that the number of internal surface flaws per unit length or one meter for the hollow tube stock was less than or equal to two, and likewise the symbol ● indicates that internal surface flaws were generated for the hollow tube stock so that the number of internal surface flaws per unit length or one meter was greater than or equal to three. The miss-rolling occurrence rate (%) is designated, in terms of percentage point, by the ratio of the number of miss-rolling to 20 billets being subjected to the piercing-rolling process under common preset setting of parameters in each rolling occasion.

As being evident from the result shown in Table 4, the inventive example satisfied either of the foregoing (1)–(3) formulas for given roll diameter ratio Dg/D1, thus there occurred no miss-rolling and the occurrence of internal surface flaws was prevented over the entire length of the hollow tube stock.

On the other hand, since the comparative example could not satisfy any one of foregoing (1)–(3) formulas, it turned out that numerous internal surface flaws were generated in Run Nos. 7 and 8 and miss-rolling frequently occurred in Run No. 9.

TABLE 4

| Run No. | Bd (mm) | Ld (mm) | D1 (mm) | Dg (mm) | Dg/D1 | N | Df(%) | N/Df | D1/Bd | Occurrence of Internal Surface Flaws | Miss-Rolling Occurrence Rate (%) | Category |
|---|---|---|---|---|---|---|---|---|---|---|---|---|
| | Roll Setting/Rolling Parameters | | | | | | | | | Result | | |
| | | | Roll Diameter Ratio | | | (1) – (3) Formulas | | | (4) Formula | | | |
| 1 | 70 | 33.4 | 352 | 410 | 1.16 | 1.35 | 5 | 27.0 | 5.03 | ● | 0 | Inventive |
| 2 | 85 | 41.7 | 341 | 380 | 1.11 | 1.39 | 6 | 23.2 | 4.01 | ○ | 0 | Example |
| 3 | 100 | 66.8 | 306 | 410 | 1.34 | 1.76 | 7 | 25.1 | 3.06 | ○ | 0 | |
| 4 | 100 | 57.2 | 288 | 400 | 1.39 | 1.62 | 8 | 20.3 | 2.88 | ○ | 0 | |
| 5 | 100 | 49.1 | 292 | 400 | 1.37 | 2.62 | 6 | 30.0 | 2.92 | ○ | 0 | |
| 6 | 100 | 49.1 | 310 | 400 | 1.29 | 5.25 | 7 | 25.1 | 3.10 | ○ | 0 | |
| 7 | 70 | 40.1 | 402 | 410 | 1.02 | 2.62 | 6 | *43.7 | 5.74 | ● | 0 | Comparative |
| 8 | 85 | 97.4 | 374 | 410 | 1.10 | 5.25 | 6 | *87.5 | 4.40 | ● | 0 | Example |
| 9 | 70 | 22.2 | 343 | 400 | 1.15 | 0.73 | 5 | *16.5 | 4.84 | ○ | 10 | |

Remarks: A prefix * to the number listed above denotes the deviation from the range specified by the present invention.

EXAMPLE 2

Likewise, the piercer mill with the configuration shown in the foregoing FIGS. 1 and 2 was used to apply the piercing-rolling process with parameters shown in Table 5 to 100 billets of 225 mm in diameter, which are made of martensitic stainless steel containing 13% Cr. The rolling parameters are in either case set so as to conform to the conditions specified by the present invention, wherein not only the onset engagement with rolls for each run but also the internal surface of the hollow tube stock at the top portion was observed.

TABLE 5

| | |
|---|---|
| Roll Gorge Diameter | 1400 mm |
| Heating Temperature | 1220° C. |
| Cross Angle γ | 20° |
| Dg/D1 | 1.16–1.21 |
| N/Df/100 | 21–35 |
| D1/Bd | 5.4–5.6 |

In the piercing-rolling operation with rolling parameters shown in Table 5, neither defective onset engagement with rolls took place nor internal surface flaws which likely becomes an issue in a final tube product generated, thus the stable piercing-rolling operation could be accomplished.

INDUSTRIAL APPLICABILITY

A manufacturing method for a seamless tube by the invention can duly control the rotary forging effect without miss-rolling such as defective onset engagement with rolls, prevent the occurrence of internal surface flaws at the top of the work material attributable to deteriorated hot workability, and further prevent the occurrence of said flaws over the remaining length next to the top without altering parameters for piercing-rolling process.

Therefore, even when a continuously cast material likely having a center segregation and/or porosity, a stainless steel with 5% or more Cr likely having δ ferrite, or a non-ferrous billet such as copper or copper alloy that a dendrite structure likely remains and impairs the workability is subjected to the inventive process, a seamless tube can be manufactured without miss-rolling, free from internal surface flaws over the entire length. Thus, the invention can be widely utilized as an excellent manufacturing method for a seamless tube.

What is claimed is:

1. A method of manufacturing a seamless tube (a tube refers to a tube or pipe generically) in which a plug is provided along a pass line lying between a pair of cone-type inclined rolls that are put in place as opposed to each other with respect to the pass line, and the seamless tube is made by applying a piercing-rolling process while a billet as the work material is subjected to rotating and traveling, said method comprising of the step that said piercing-rolling process is applied so that both Dg/D1 or the ratio of a roll diameter Dg (mm) at the gorge portion of an inclined roll to an inlet roll diameter D1 (mm), and N/Df or the ratio of a billet revolution N, being given during the period from an onset engagement of said billet with rolls to the travel down to a plug nose, to a billet diameter reduction rate Df (%) satisfy either of following (1)–(3) formulas:

in case of Dg/D1<1.1, $$23 \leqq N/(Df/100) \leqq 40, \quad (1)$$

in case of 1.1≦Dg/D1<1.5, $$20 \leqq N/(Df/100) \leqq 44, \quad (2)$$

in case of 1.5≦Dg/D1≦1.8, $$20 \leqq N/(Df/100) \leqq 48, \quad (3)$$

provided that following relationships are compatible, given by Ld: pass line lead (mm) from the position where the billet first engages with rolls to the plug nose, β: inclination angle (°) of the inclined rolls, and Rpg: opening clearance (mm) of the inclined rolls at the plug nose position, $$N = Ld/(2\pi \cdot Bd \cdot \tan\beta), \text{ and}$$

$$Df = \{(Bd - Rpg)/Bd\} \times 100.$$

* * * * *

UNITED STATES PATENT AND TRADEMARK OFFICE

CERTIFICATE OF CORRECTION

PATENT NO. : 7,100,410 B2
APPLICATION NO. : 11/281485
DATED : September 5, 2006
INVENTOR(S) : Yamakawa et al.

It is certified that error appears in the above-identified patent and that said Letters Patent is hereby corrected as shown below:

Column 10, line 54:
"(°) of the inclined rolls, and Rgp: opening clearance (mm) of"
should read:
"(°) of the inclined rolls, Bd: billet diameter, and Rpg: opening clearance (mm) of"

Signed and Sealed this

Seventeenth Day of February, 2009

JOHN DOLL
*Acting Director of the United States Patent and Trademark Office*